US008627530B2

(12) United States Patent
Byun et al.

(10) Patent No.: US 8,627,530 B2
(45) Date of Patent: Jan. 14, 2014

(54) CONSTRUCTING METHOD OF CABLE-STAYED BRIDGE AND TEMPORARY CABLE THEREFOR

(75) Inventors: Jong Kwan Byun, Busan (KR); Won Ho Kang, Busan (KR)

(73) Assignee: Dong-A University Research Foundation for Industry-Academy Cooperation, Busan (KR)

( * ) Notice: Subject to any disclaimer, the term of this patent is extended or adjusted under 35 U.S.C. 154(b) by 0 days.

(21) Appl. No.: 13/508,313

(22) PCT Filed: Nov. 4, 2010

(86) PCT No.: PCT/KR2010/007748

§ 371 (c)(1), (2), (4) Date: May 4, 2012

(87) PCT Pub. No.: WO2011/055996

PCT Pub. Date: May 12, 2011

(65) Prior Publication Data

US 2012/0216357 A1 Aug. 30, 2012

(30) Foreign Application Priority Data

Nov. 6, 2009 (KR) ..... 10-2009-0106807

(51) Int. Cl.
*E01D 21/00* (2006.01)
*E01D 21/10* (2006.01)
*E01D 19/16* (2006.01)

(52) U.S. Cl.
USPC ..... 14/77.1; 14/18; 14/22; 14/23

(58) Field of Classification Search
USPC ..... 14/18–23, 74.5, 77.1, 77.3
See application file for complete search history.

(56) References Cited

U.S. PATENT DOCUMENTS 3,832,748 A * 9/1974 Ogletree ..... 14/77.1
4,352,220 A * 10/1982 Wittfoht ..... 14/77.1
4,628,560 A * 12/1986 Clevett et al. ..... 14/2.4

(Continued)

FOREIGN PATENT DOCUMENTS

JP 5171619 7/1993
JP 2002061114 2/2002

(Continued)

OTHER PUBLICATIONS

International Search Report (With English Translation) and Written Opinion Dated Jul. 7, 2011 From Corresponding Application No. PCT/KR2010/007748.

*Primary Examiner* — Raymond W Addie
(74) *Attorney, Agent, or Firm* — Ohlandt Greeley Ruggiero & Perle L.L.P.

(57) ABSTRACT

The present invention relates to a method for constructing a cable-stayed bridge with a tensionless stay cable, including the steps for: constructing a main tower 100, continuously installing a suspension cable 200 over a main span and a side span, installing a plurality of hangers 210 on the suspension cable 200, arranging an anchorage cable 220 in a longitudinal direction by connecting the anchorage cable 220 to a lower end of the hanger 210, installing a stay cable 110 in sequence, constructing a girder by connecting a segment 300 constituting the girder to each of the stay cables 110 in sequence, and connecting the segments 300 one another in a longitudinal direction, and removing the suspension cable 200, the hanger, and the anchorage cable 220.

5 Claims, 18 Drawing Sheets

(56) References Cited

U.S. PATENT DOCUMENTS

| | | | | |
|---|---|---|---|---|
| 4,742,591 | A * | 5/1988 | Muller | 14/77.1 |
| 4,777,686 | A * | 10/1988 | Muller | 14/77.1 |
| 4,799,279 | A * | 1/1989 | Muller | 14/77.1 |
| 5,896,609 | A * | 4/1999 | Lin | 14/20 |
| 6,292,967 | B1 * | 9/2001 | Tabatabai et al. | 14/22 |
| 6,301,736 | B1 * | 10/2001 | Knolle | 14/22 |
| 6,728,987 | B1 * | 5/2004 | Hinman | 14/77.1 |
| 7,415,746 | B2 * | 8/2008 | Tao | 14/77.1 |
| 7,478,450 | B2 * | 1/2009 | Fong | 14/77.1 |
| 2011/0283467 | A1 * | 11/2011 | Bahat | 14/21 |

FOREIGN PATENT DOCUMENTS

| | | |
|---|---|---|
| JP | 2004107951 | 4/2004 |
| JP | 2007051426 | 3/2007 |
| KR | 100803077 | 4/2008 |

* cited by examiner

CONSTRUCTING METHOD OF CABLE-STAYED BRIDGE AND TEMPORARY CABLE THEREFOR

TECHNICAL FIELD

The present invention relates to a method for constructing a cable-stayed bridge and a temporary cable therefor. More particularly, the present invention relates to a method for constructing a cable-stayed bridge, which pre-installs a stay cable using a suspension bridge type temporary cable in constructing a cable-stayed bridge, which supports a girder for the upper structure of a bridge, so that a load exerted on the girder and the stay cable, which constitutes an upper structure of the bridge, can be minimized without introduction of initial tension to the stay cable, and a temporary cable therefor.

BACKGROUND ART

Advantages of a cable-stayed bridge, which includes a main tower, a stay cable, and a girder as main components, are that it has good appearance and the stay cable serves as an elastic support for the girder and thus transmits a load of the girder to the main tower. Therefore, a bridge having a long span of 200 m or more as a length between main towers can be constructed in the form of a cable-stayed bridge, and such a cable-stayed bridge is mainly built over wide and deep river or sea.

Therefore, in constructing a cable-stayed bridge, distribution of force on a structure or a construction period is greatly affected by constructing methods of a stay cable and a girder, and finally, the economic feasibility of construction of a cable-stayed bridge depends on constructing methods of a stay cable and a girder. As a related-art cable-stayed bridge constructing method, a cantilever type constructing method, in which a girder is formed by installing segments on a main tower in sequence, is used. FIGS. 1 to 4 are schematic side views illustrating each of steps for constructing a cable-stayed bridge in a related-art cantilever type constructing method. In order to construct a cantilever type cable-stayed bridge according to the related-art constructing method, a main tower 100 is installed first and a segment 120, which consists of small blocks of about 10 m~12 m, is situated in a bridge-axis direction (a longitudinal direction). A stay cable 110 is connected between the segment 120 and the main tower 100 and initial tension is introduced to the stay cable 110. In such a method, the segments 120 are installed in sequence and are connected to one another, so that a girder is formed. That is, as shown in FIGS. 1 to 4, the segments 120 are continuously installed in sequence from each of the main towers 100 using the stay cable 110 and the segments in the middle are bonded to one another, so that a girder connecting an entire span is formed.

However, since the related-art constructing method should perform the steps for installing the segment 120, anchoring the stay cable 120, and introducing the initial tension in sequent, it has a disadvantage of requiring much time to construct the entire bridge.

The initial tension introduced to the stay cable 110 when the segment 120 is installed is greater than tension exerted on the stay cable 110 by a load when the construction of the bridge is completed and the bridge is used. After the initial tension is introduced, the tension of the stay cable 110 is gradually decreased when the segments 120 are installed in sequence. In the related-art constructing method described above, since the initial tension greater than the tension in a practical use state should be introduced to the stay cable 110 in order to support the segment 120, tension greater than a load exerted in practice is exerted on the stay cable 110. To achieve this, the stay cable 110 should be manufactured bigger than that in the practice use state and thus unnecessary steel materials are consumed for the stay cable 110. Therefore, there are problems of a waste of resources and an increased cost.

Also, in the related-art constructing method, a great compressive force is generated on the segment 120 in a longitudinal direction (a bridge-axis direction) due to the initial tension introduced to the stay cable 110, and there is a disadvantage that a cross section of the segment 120 should be unnecessarily increased. Also, since the girder is constructed with the segment 120 having a longitudinal length of about 10 m~12 m, a joint portion should be formed on every segment 120. Therefore, in order to connect the segments 120 one another, a plurality of connection plates are used and the number of processes of connecting the segments 120 such as high tension bolting or welding increase. Thus, there are problems of an increased cost and a delay in a construction period.

Also, in the related-art constructing method, since the steps for installing the segment 120, anchoring the stay cable, and introducing the initial tension should be performed in sequence, the segment 120 connected to one another forms a cantilever structure prior to completion of the bridge, and, such a cantilever structure of a long span is maintained for a long time during a bridge construction period. Therefore, this structure is vulnerable to a natural environment such as typhoon and an extra wind resisting means such as a stiffening cable to connect a lower portion of the segment 120 to the main tower 100 and support the segment 120 is required. Furthermore, since the tension exerted on each of the stay cables 110 is changeable during the bridge construction period, structural calculation to form a final bridge shape is complicated and much time and much money are required to design the bridge. That is, it is difficult to manage the shape, design, and construction of the girder.

DETAILED DESCRIPTIONS

Technical Object

The present invention has been developed in order to solve the problems and disadvantages of the related-art cable-stayed bridge constructing method using the cantilever method, and an object of the present invention is to minimize a time that is required to install a girder and a stay cable, which require a longest construction period in installing a cable-stayed bridge.

An object of the present invention is to minimize a stress exerted on a segment of a girder and a stay cable by not introducing initial tension to the stay cable, and accordingly prevent unnecessary expansion of a cross section of the segment and the stay cable and thus prevent a waste of resources and an increased material cost.

Also, an object of the present invention is to shorten a construction period required to construct a bridge by using a segment of a big block, minimize use of a connection plate, a high tension bolt, or welding to connect the segments, and minimize the number of materials or devices used to install a girder and a stay cable.

Also, an object of the present invention is to avoid necessity for a wind resistant device, which is required due to a long-time construction, by installing a segment and a stay cable in a short time, and thus save a cost.

Technical Solution

In order to achieve the above objects, the present invention provides a method for constructing a cable-stayed bridge, which installs a temporary cable including a suspension cable, a hanger, and an anchorage cable, installs a stay cable over an entire span of the bridge in a stress-free state, manufactures a segment in the form of a big block, installs the segment on the stay cable, forms a girder by connecting the segments to one another, and removes the temporary cable, thereby completing a cable-stayed bridge.

Also, the present invention provides a temporary cable used in the above-described constructing method.

Effects of the Invention

According to the present invention, since the stay cable is pre-installed in the stress-free state without introduction of initial tension, unnecessary expansion of a cross section of the stay cable, which is caused by the introduction of the initial tension, can be prevented, unlike in the related-art cantilever constructing method. Therefore, a waste of resources and an increased material cost can be prevented. Also, since stressing device to introduce the initial tension is not required, a cost can be saved and a construction period can be shortened. Furthermore, since initial tension is not introduced to the stay cable in the present invention, a longitudinal axis force exerted on the segment can be minimized, and as a result, a cross section of the segment can be reduced.

Also, according to the present invention, since all of the stay cables are installed in advance at once before the girder is installed, a time required to install the stay cables can be noticeably reduced. Also, since the girder is installed with the segment of a big block, a time required to install the girder can be reduced.

In particular, according to the present invention, since the girder is installed with the segment of the big block, the number of joint portions between the segments can be minimized and use of a connection plate or a high tension bolt, or welding can be minimized. Also, the number of materials and devices used to install the girder and the stay cable can be minimized.

Furthermore, according to the present invention, a time during which the segment is in a cantilever structure in the process of being connected to one another can be reduced and an extra wind resisting means is not required, and thus a cost can be saved.

BEST EMBODIMENT OF THE INVENTION

A method for constructing a cable-stayed bridge including a plurality of main towers, and an anchor pier located outside each of the main towers, includes the steps for: constructing the main tower, continuously installing a suspension cable over a main span between the two main towers and over a side span between each of the main towers and the anchor pier, installing a plurality of hangers to vertically hang from the suspension cable with a gap therebetween, connecting an anchorage cable, which continuously extends over the main span and the side span in a longitudinal direction, to a lower end of each of the hangers, and arranging the anchorage cable in a longitudinal direction by anchoring the anchorage cable to an upper end of the anchor pier and a middle of the main tower, installing a stay cable in an estimated stay cable installation section in sequence by connecting the stay cable between an upper end of the main tower and the anchorage cable, the stay cable supporting a segment to constitute a girder, constructing a girder by pre-manufacturing a segment constituting the girder, transferring the segment, installing the segment by connecting the segment to each of the stay cables in sequence, and connecting the segments one another in a longitudinal direction, and removing the suspension cable, the hanger, and the anchorage cable.

According to the present invention, a temporary cable is a temporary cable to install a stay cable to support a segment constituting a girder in a stress-free state in a cable-stayed bridge, which includes a main tower and an anchor pier located outside each of the main towers.

The temporary cable of the present invention includes: a suspension cable which is continuously installed over a main span between the both main towers and over a side span between each of the main towers and the anchor pier, a plurality of hangers which are installed to vertically hang from the suspension cable with a gap therebetween, and an anchorage cable which continuously extends over the main span and the side span in a longitudinal direction, is connected to a lower end of each of the hangers, is arranged in a longitudinal direction by being anchored to an upper end of the anchor pier and a middle of the main tower, and which is connected to a lower end of the stay cable which has an upper end connected to the main tower, and makes the stay cable in a tensionless state before the segment is installed, and the temporary cable is removed when the stay cable is installed and the girder is installed by assembling the segments with one another.

Best Embodiments of the Invention

A method for constructing a cable-stayed bridge according to an exemplary embodiment will be explained with reference to FIGS. 5 to 18. FIGS. 5 to 18 are schematic side views illustrating each of steps for constructing a cable-stayed bridge according to an exemplary embodiment.

Figure 1:
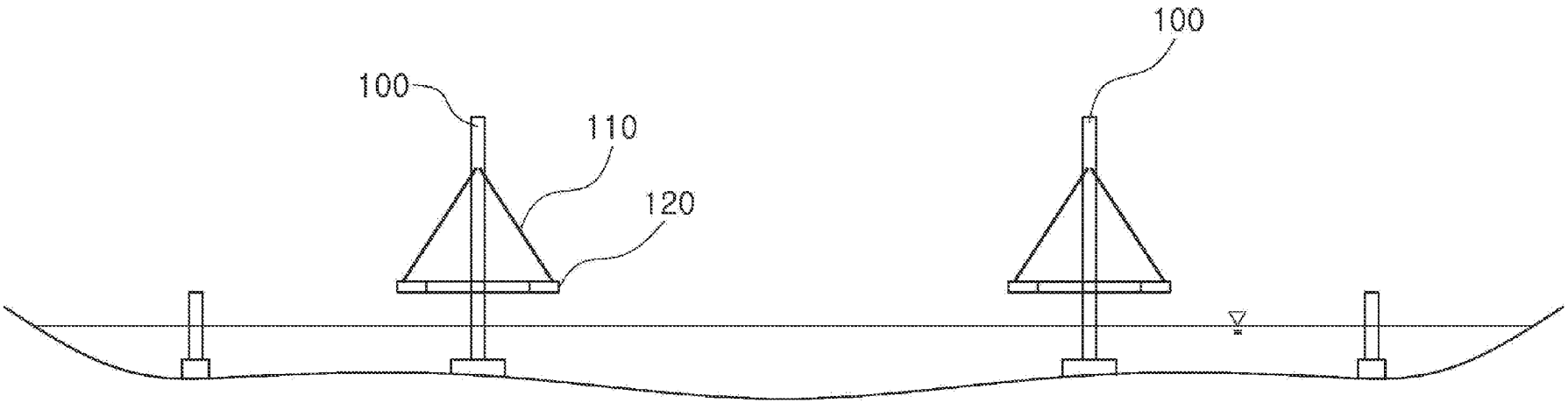
PRIOR ART FIG. 1
FIGS. 1 to 4 are schematic side views illustrating each of steps for constructing a cable-stayed bridge using a related-art cantilever type constructing method.
Figure 2:
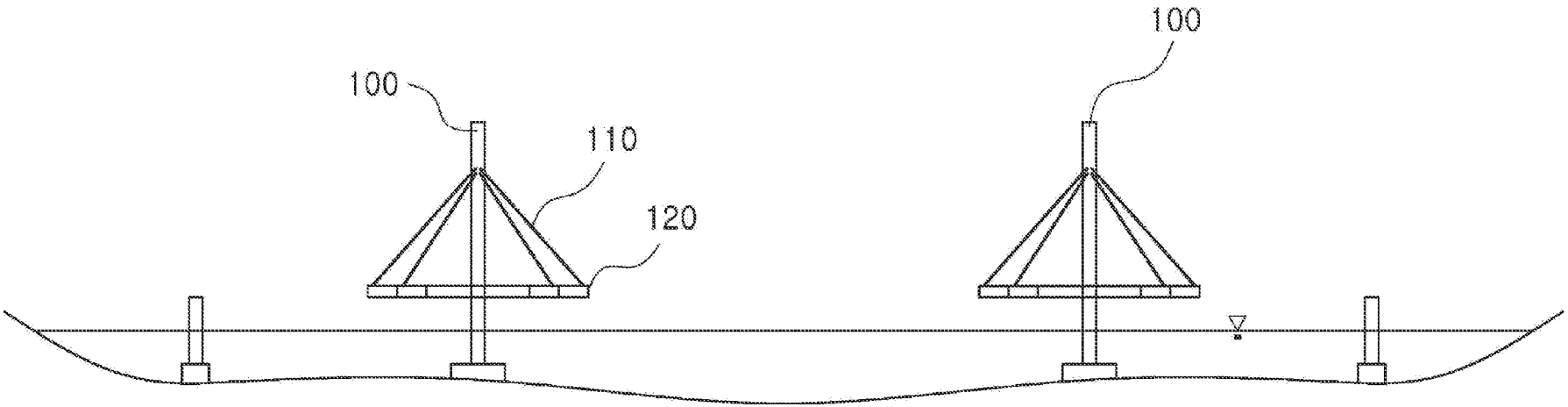
PRIOR ART FIG. 2
Figure 3:
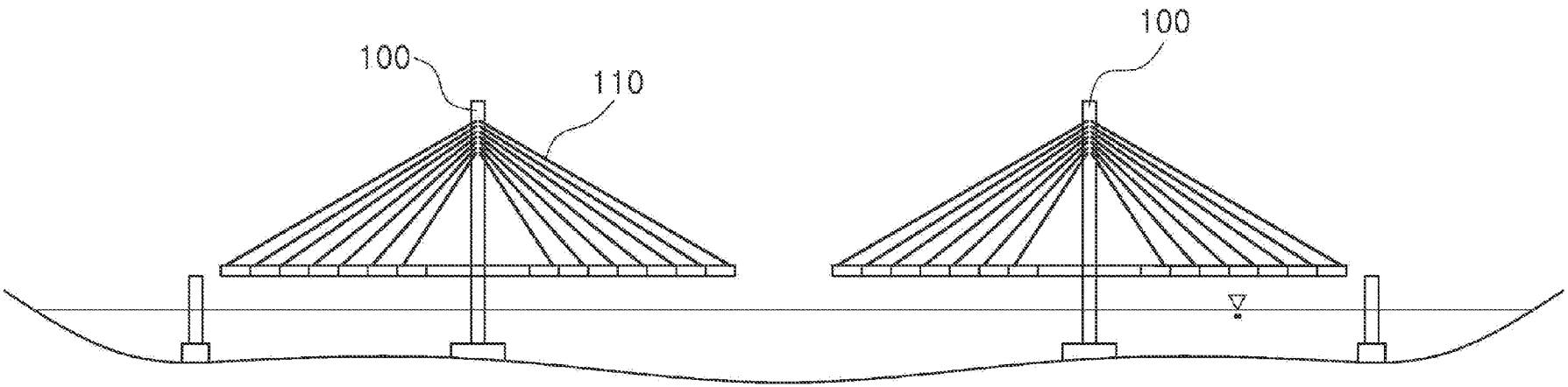
PRIOR ART FIG. 3
Figure 4:
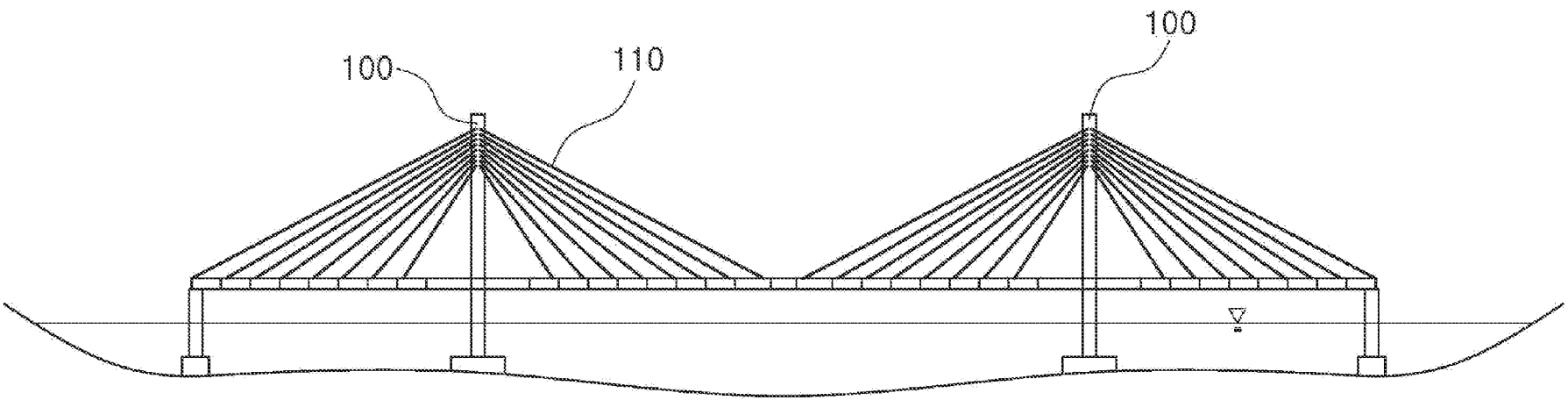
PRIOR ART FIG. 4
Figure 5:
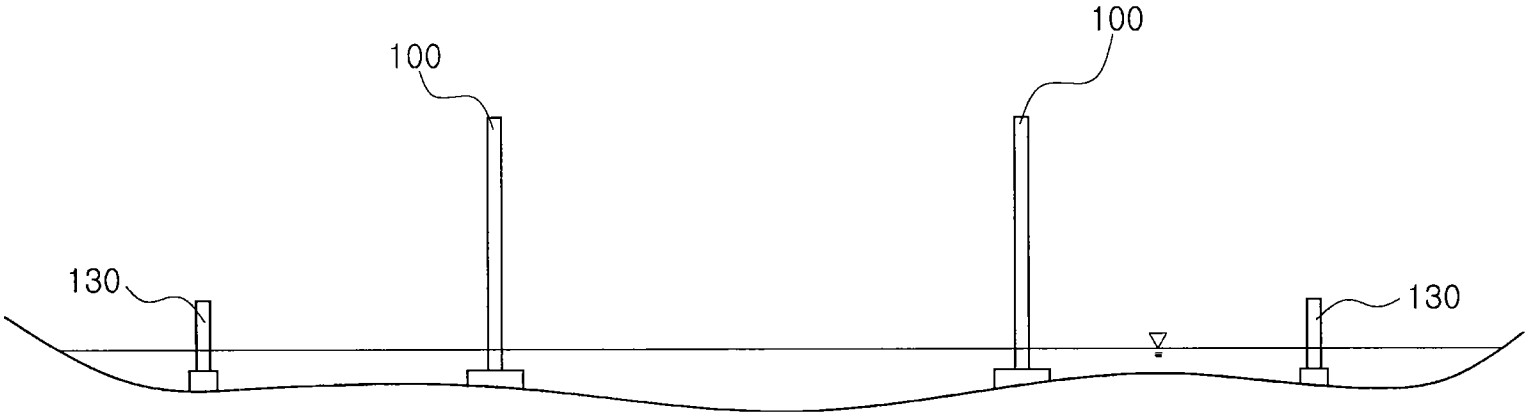
FIGS. 5 to 18 are schematic side views illustrating each of steps for constructing a cable-stayed bridge according to an exemplary embodiment.

First, a step for constructing a main tower is performed. That is, as shown in FIG. 5, vertical main tower 100 are installed. When the main towers 100 are constructed, stay cables are installed over an entire span of a bridge in a stress-free state. In the present invention, the temporary cable includes a suspension cable 200, hangers 210, and an anchorage cable 220.

Figure 6:
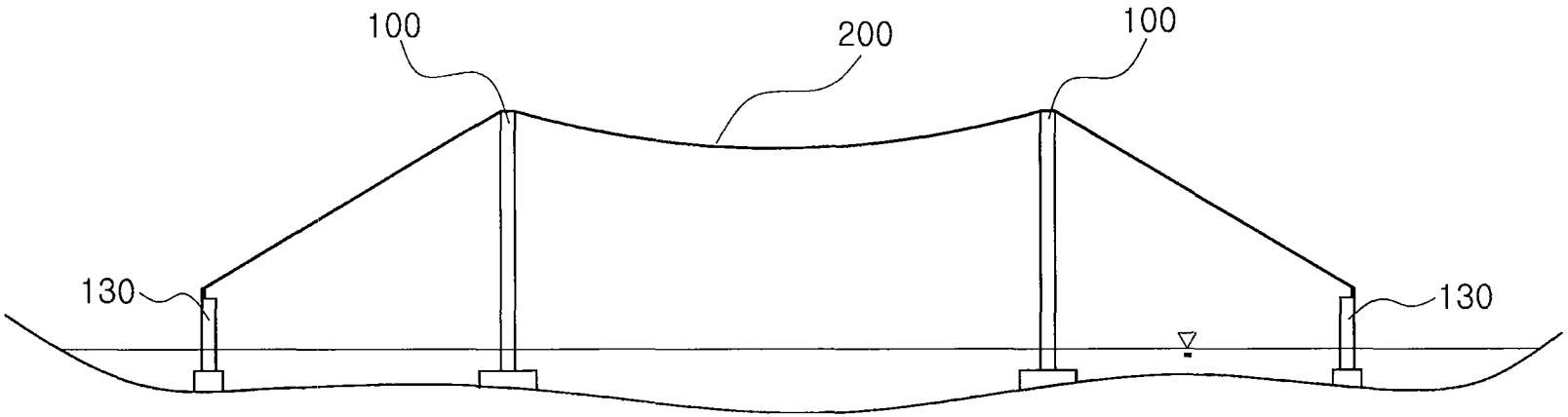

Specifically, after the main towers 100 are installed, the suspension cable 200 is installed across the main towers 100. That is, as shown in FIG. 6, the suspension cable 200 is continuously installed between upper ends of the both main towers 100 (a main span) and between upper ends of anchor piers 130 located outside each of the main towers 100 and the main tower (a side span). The suspension cable 200 has a function of allowing the anchorage cables 220, which is provided to install stay cables 110 in advance, to be installed in a bridge-axis direction according to longitudinal gradient and camber of the bridge, along with the hangers 210, which will be described below. To install the suspension cable 100 continuously to be suspended between the main towers 100 and the anchor piers 130, a related-art cable installing method such as parallel wire strands (PWS) may be used. However, the installing method of the suspension cable 200 is not limited to the PWS and other methods such as air spinning (AS) may be used.

Figure 7:
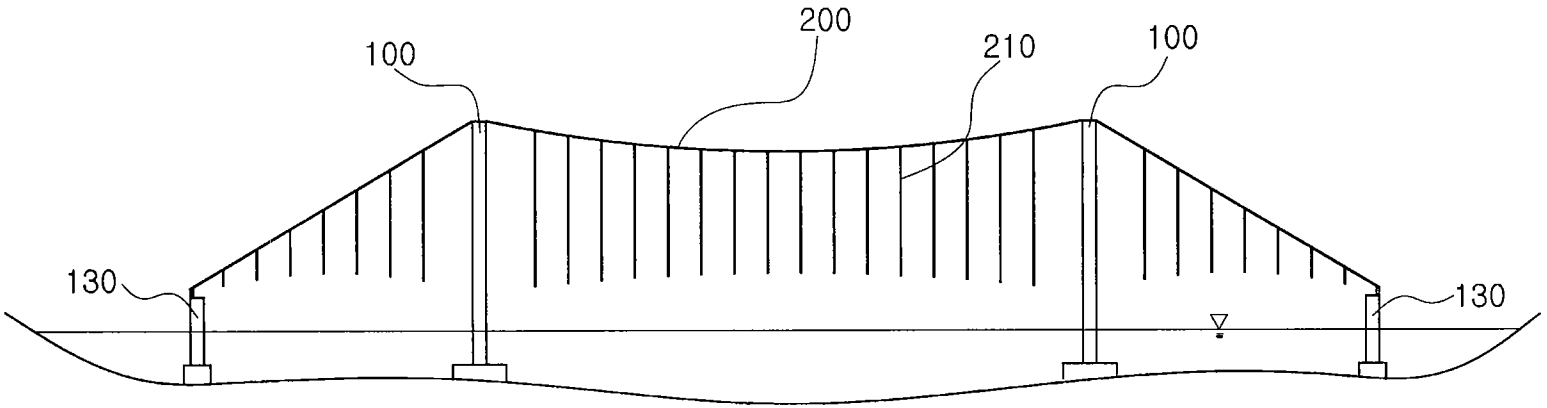

After the suspension cable 200 is installed, the hangers 210 are installed to hang from the suspension cable 200 with a gap therebetween. That is, as shown in FIG. 7, a plurality of hangers 210 made of a cable are connected to the suspension cable 200 at their upper ends with the gap therebetween, and are installed to hang in a vertical direction. At this time, a length adjusting device may be installed in the hanger 210 to adjust a length of the hanger 210 easily. If the length of the hanger 210 is adjusted by the length adjusting device, the method has an advantage of adjusting a location of an anchorage opening of the stay cable easily and safely in a short time afterward. The length adjusting device may be a well-known device for adjusting a length of a cable. The present invention does not limit the length adjusting device to a specific device and thus a detailed description of the length adjusting device is omitted.

Figure 8:
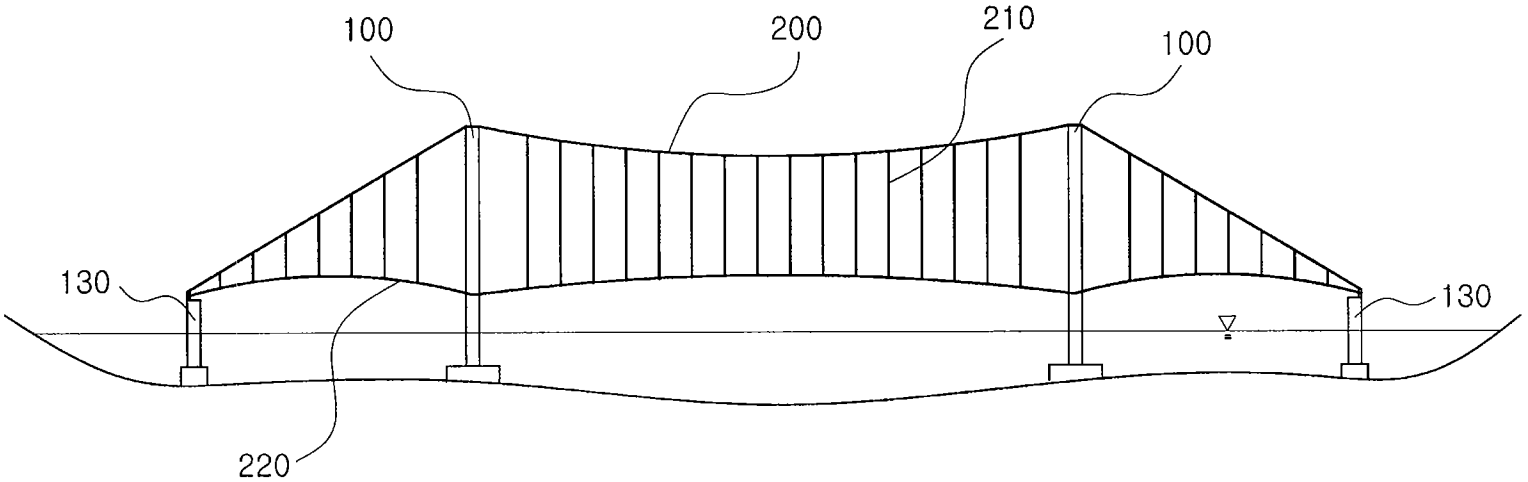

After the installation of the suspension cable 200 and the hanger 210 is completed, as shown in FIG. 8, the anchorage cable 220, which continuously extends over the main span and the side span in the longitudinal direction, is connected to lower ends of the hangers 210, and the anchorage cable 220 is arranged in the longitudinal direction by anchoring opposite ends of the anchorage cable 220 to an upper end of the anchor pier 130 and a middle of the main tower 100, respectively. When the suspension cable 200 and the anchorage cable 220 are installed, tension may be introduced to the suspension cable 200 and the anchorage cable 220 in order to maintain the shapes of the cables according to a longitudinal curve or camber of the bridge.

Figure 9:
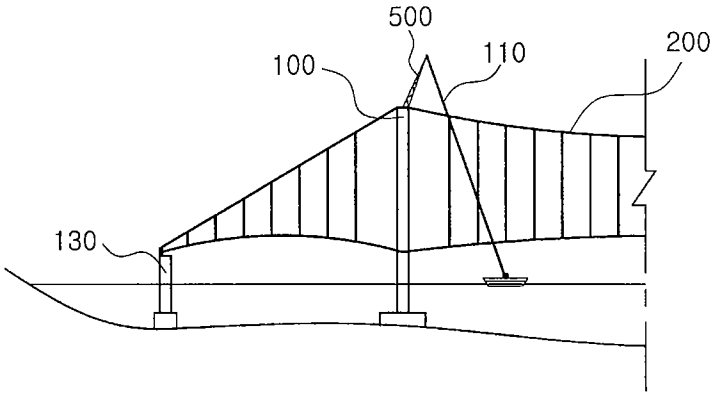
Figure 10:
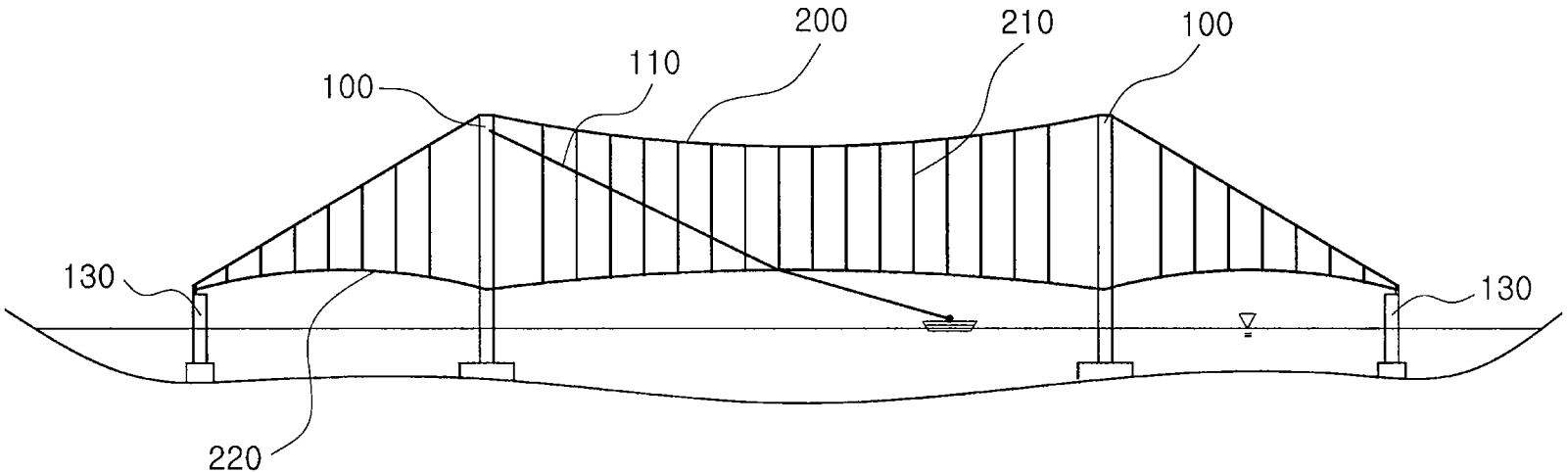
Figure 13:
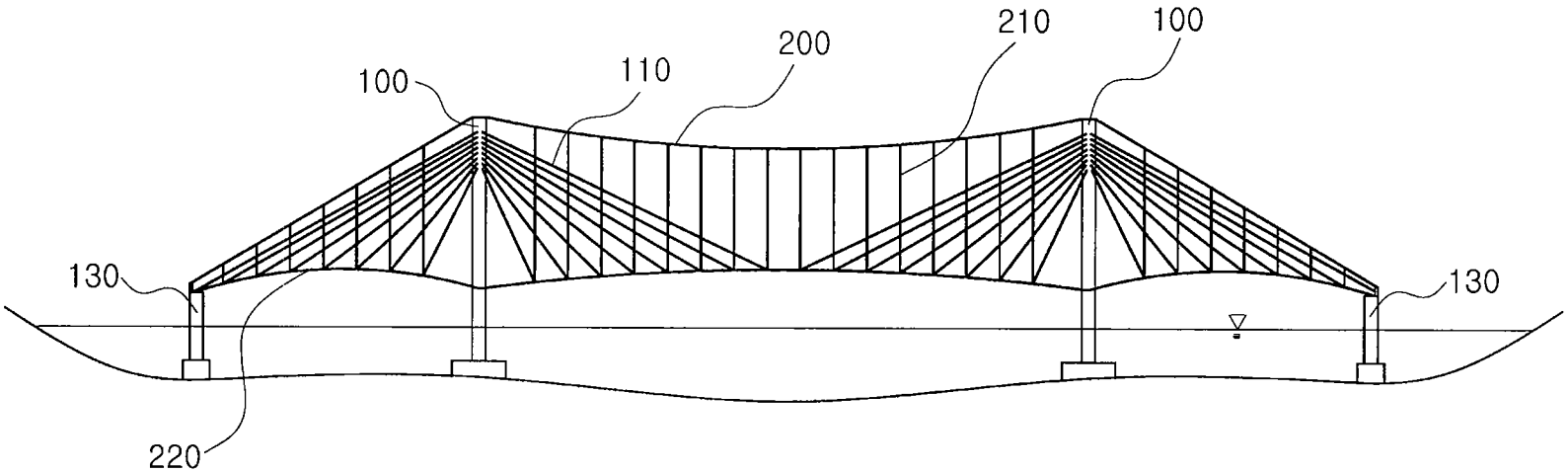

After the installation of the temporary cable is completed by installing the suspension cable 200, the hangers 210, and the anchorage cable 220, the stay cables 110 to support a segment constituting a girder are installed. FIGS. 9 and 13 illustrate a process of installing the stay cable 110 in detail. In FIG. 9, only the main tower 100 and the anchor pier 130 on one side are illustrated. As shown in FIG. 9, an upper end of a stay cable 110 is connected to an upper end of the main tower 100 first. Next, as shown in FIG. 10, a lower portion of the stay cable 110 is connected to the anchorage cable 220. At this time, a lower end of the stay cable 110 is connected to the anchorage cable 220 from a point of view in an estimated stay cable installation section existing in a center of the main span located between the both main towers 100, and from a point of view in an estimated stay cable installation section in a direction toward the anchor pier 130 in the side span located between the anchor pier 130 and the main tower 100. A temporary fixing hook may be used to connect the upper end of the stay cable 110 to the upper end of the main tower 100 prior to connecting the lower end of the stay cable 110 to the anchorage cable 220. That is, the temporary fixing hook is provided at the upper end of the main tower 100. The upper end of the stay cable 110 is drawn up using a crane 500 and is hooked to the upper end of the main tower 100 using the temporary fixing hook. Then, the stay cable 100 is pulled toward the other main tower 100 using a salvage ship 150 and the lower portion of the stay cable 110 is connected to the anchorage cable 220. An anchorage device is provided in the anchorage cable 220 to be connected to the stay cable 110. The remaining portion of the stay cable 110 under the portion connected to the anchorage cable 220 is cut off and is removed.

Figure 11:
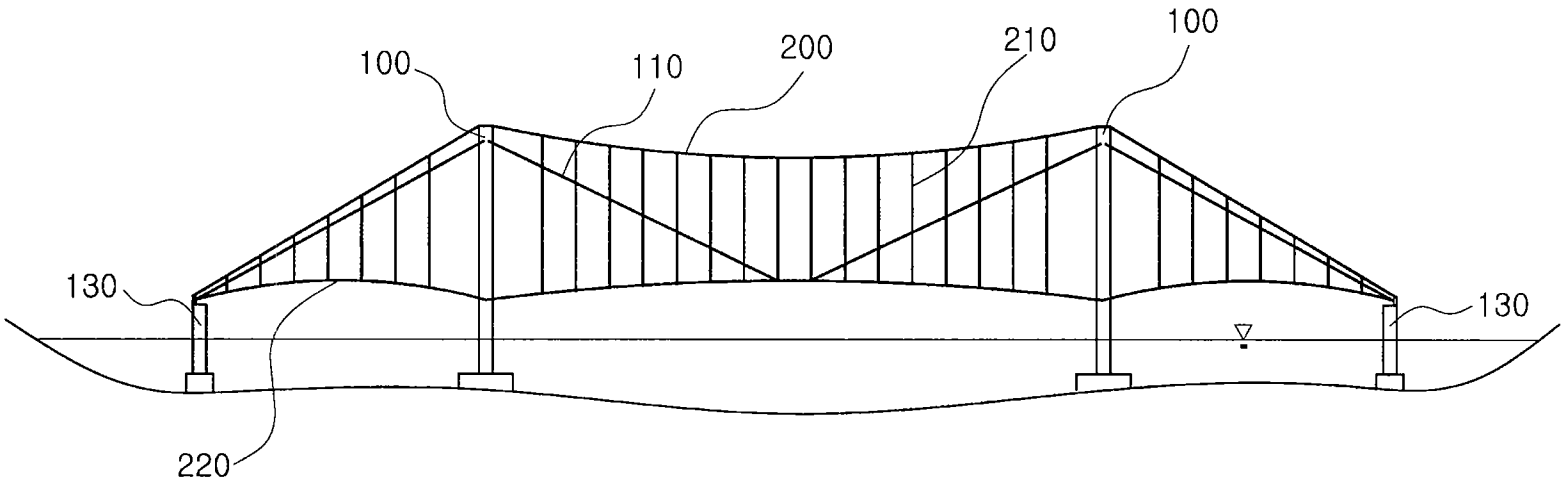
Figure 12:
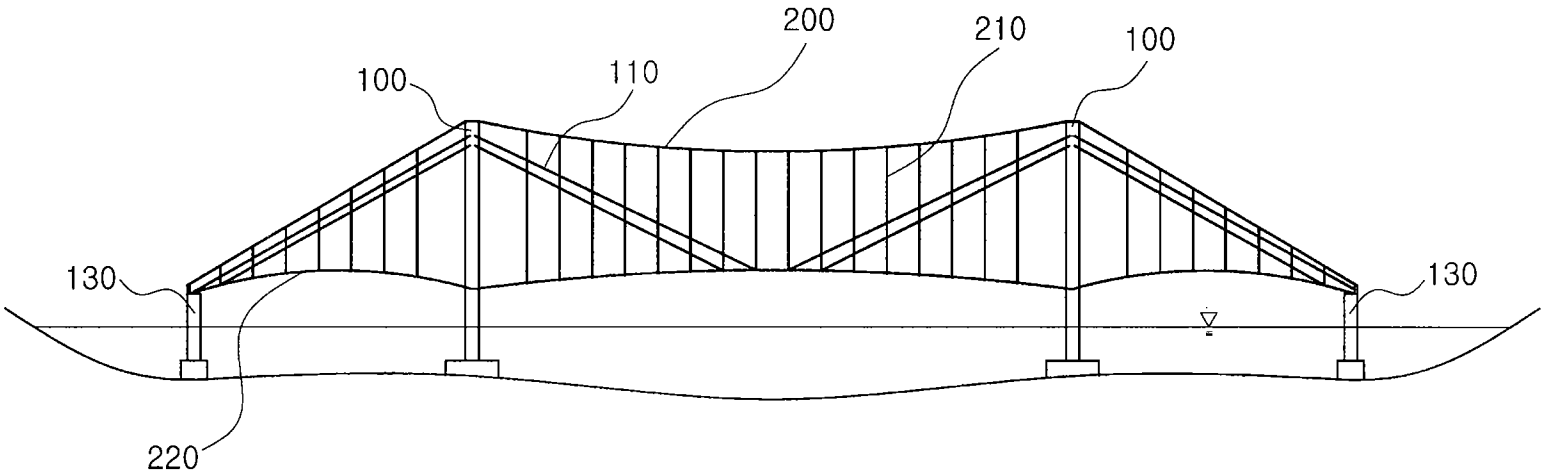

If the temporary fixing hook is used to connect the upper end of the stay cable 110 to the upper end of the main tower 100, the upper end of the stay cable 110 is anchored to a permanent anchorage portion of the main tower 100 securely and permanently after the lower portion of the stay cable is connected to the anchorage cable 220. As shown in FIGS. 11 to 13, the operation of connecting the upper end of the stay cable 110 and the upper end of the main tower 100 and connecting the lower end of the stay cable 110 and the anchorage cable 220 is performed from the center of the main span in a direction toward the main tower 100 in the estimated stay cable installation section, and from the anchor pier 130 of the side span in a direction toward the main tower 100, in sequence, and is performed on the both main towers 100 alternately. That is, preferably, the stay cable 110 is installed from the center of the main span in a direction toward the main tower 100 from the point of view in the estimated stay cable installation section existing in the center of the main span in sequence, and in a direction toward the main tower 100 from the point of view of the estimated stay cable installation section in the side span located between the anchor pier 130 and the main tower 100 in sequence.

Through the above-described process, the stay cable 110 is installed between the main tower 100 and the anchorage cable 220 over the main span and the side span of the bridge in a stress-free state in advance. The "stress-press state" recited herein refers to a state in which initial tension to support the segment 300 or tension caused by a load of the segment 300 is not exerted on the stay cable 110.

Unlike in the related-art cantilever type constructing method, the stay cable 110 in the present invention is in the stress-free state without introduction of initial tension, and accordingly, unnecessary expansion of a cross section of the stay cable 110, which is caused by the introduction of the initial tension, can be prevented. Therefore, a waste of resources and an increased material cost can be prevented. Also, since the initial tension is not introduced to the stay cable 110, a stressing device to introduce the initial tension is not required and thus a cost can be saved and a construction period can be shortened.

In particular, since the initial tension is not introduced to the stay cable 110, a longitudinal axial force, which is exerted on the segment 300 through the stay cable 110 due to the initial tension, can be minimized, and as a result, a phenomenon in which a compressive stress is excessively exerted on the segment 300 does not occur, and thus, a cross section of the segment 300, which is vulnerable to buckling caused by a compressive force, can be reduced.

As described above, according to the present invention, the stay cable 110 is installed in the stress-free state and the initial tension is not introduced. As a result, a time required to construct the stay cable 110 and the girder using the segment 300 can be reduced and an amount of material used can be reduced, so that the present invention is advantageous in the economic point of view. Furthermore, since the stay cable 110 is installed over the entire span of the bridge in advance according to the present invention, a time required to install the stay cable 110 permanently can be reduced and thus a construction period can be shortened. Also, human resources can be effectively utilized and thus a construction cost can be saved. That is, in the related-art cable-stayed bridge constructing method of the cantilever method, processes of installing one segment, connecting a lower end of a stay cable to the segment to support the segment, and then stressing the stay cable are repeated on every segment. Therefore, a preparatory work to bring devices or materials into a construction site to install, connect, and stress a stay cable should be performed every time each segment is installed, and a measuring work to manage the shape should be performed on every segment. Thus, much time is required to construct the bridge.

On the other hand, in the constructing method according to the present invention, the installation of the stay cable is performed intensively. Accordingly, a preparatory work to install the stay cable is not repeated at time intervals and is performed collectively. Also, since the segment is installed simply by anchoring the end of the stay cable to an anchorage portion of the segment without having to introduce tension to the stay cable, the work is easy and simple. Therefore, according to the present invention, a construction period required to construct the bridge can be shortened. Also, since the installation of the stay cable is performed intensively, cable installation engineers and workers are utilized intensively rather than at time intervals, and accordingly, an increase in a construction cost caused by extended human resource utilization can be prevented.

Figure 14:
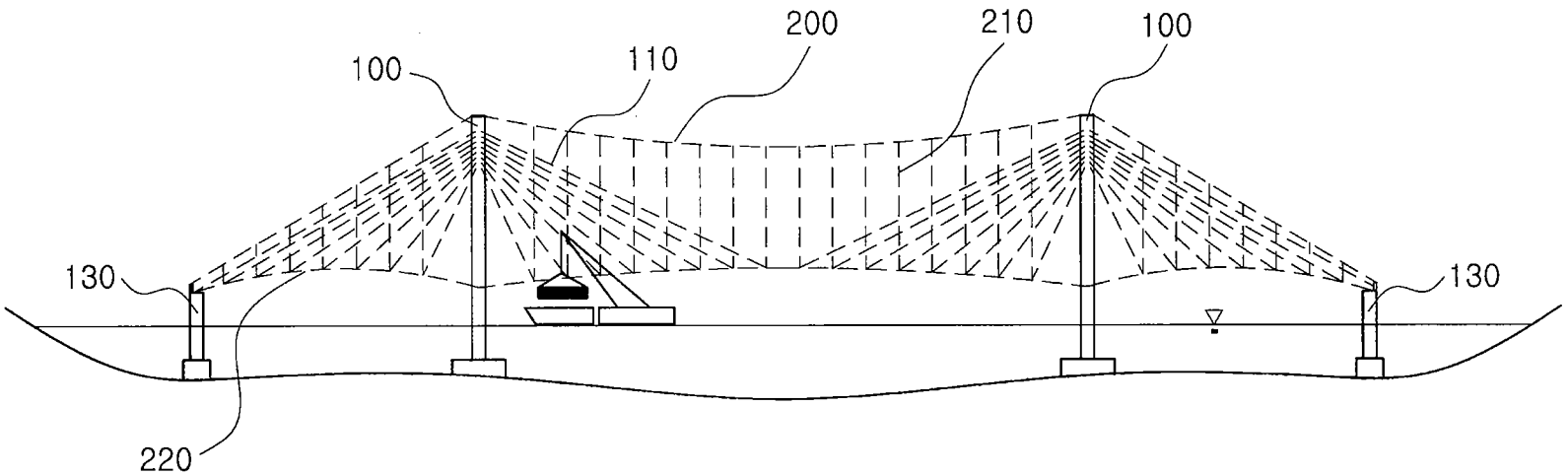

After the stay cable 110 is installed over the entire span of the bridge, the girder is formed by installing and assembling the segment. FIGS. 14 to 17 illustrate each of steps for constructing the girder by installing the segment 300. First, the segment 300 manufactured in a separate place is transferred and salvaged to a site as shown in FIG. 14. At this time, a marine crane or a marine barge 160 may be used. In the present invention, the segment 300 is formed of a big block. For example, the segment 300 may be formed with a big block having a longitudinal length of 50 m to 70 m.

In the related-art cable-stayed bridge constructing method of the cantilever method, a segment is positioned and a stay cable is connected to the segment so that the segment supports the segment at the pre-stage. Therefore, a process in which the segment is supported in a cantilever state exists. If the segment is manufactured with a block bigger than a block having a longitudinal length of 10 m~12 m, the segment may sag and a stress may be generated in the cantilever state. Accordingly, in order to support the segment, a great load is exerted on the stay cable and thus a size of the stay cable is bigger to the extent that it is difficult to construct a bridge in practice.

To this end, the related-art cable-stayed bridge constructing method of the cantilever method has no choice but to manufacture the segment with a small block, and accordingly, cannot avoid the problems such as an increased number of joint portions and an increase in the time required to form a girder. However, in the present invention, since the stay cable to support the segment is already installed, the entire girder (the entire main span or the entire side span) may be installed at once and the segment 300 constituting the girder may be manufactured with a big block having a longitudinal length of 50 m to 70 m. If the segment 300 of the big block is used, the time required to manufacture the girder can be noticeably reduced and also the number of joint portions between the segments 300 can be reduced, so that the use of a connection plate and a high tension bolt used for the joint portion can be minimized, and accordingly, a cost can be saved and a construction period can be shortened.

Figure 15:
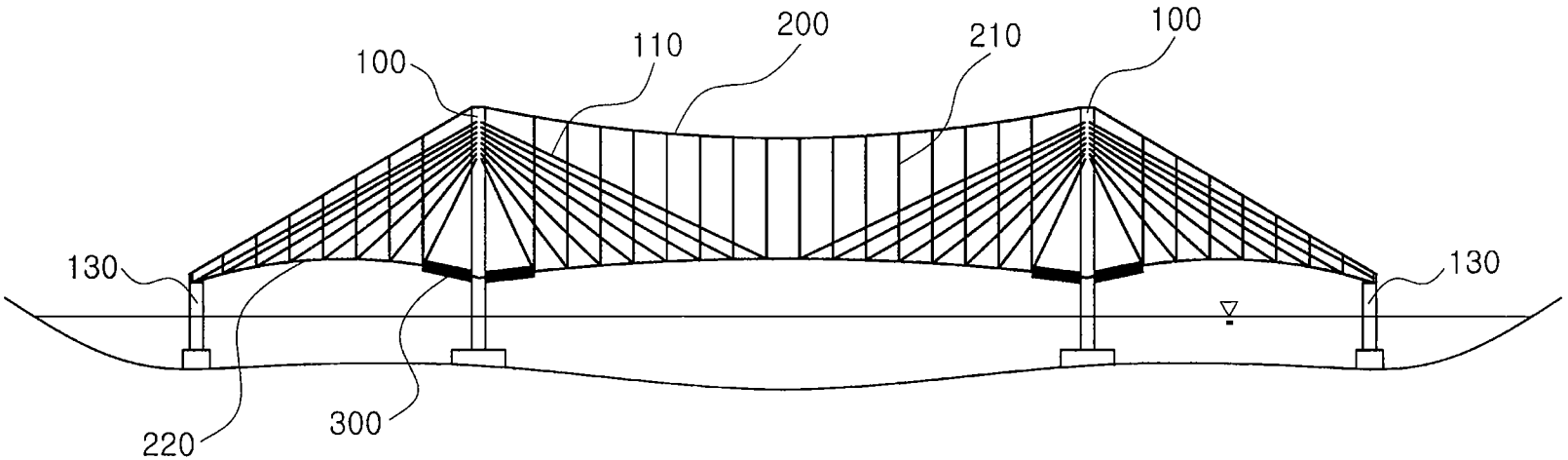
Figure 16:
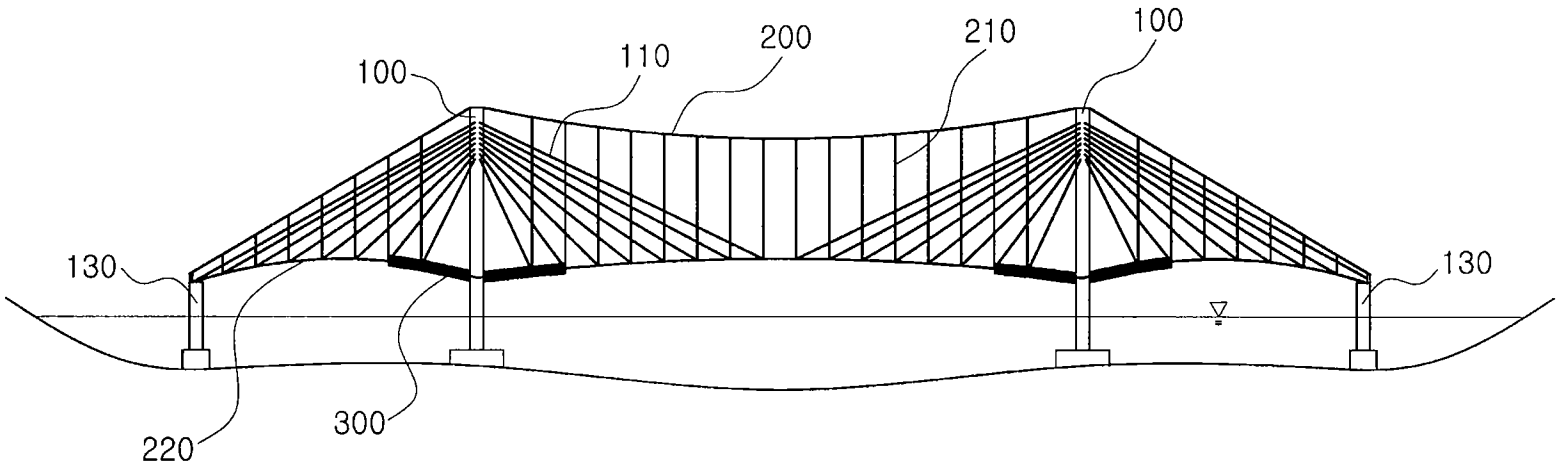
Figure 17:
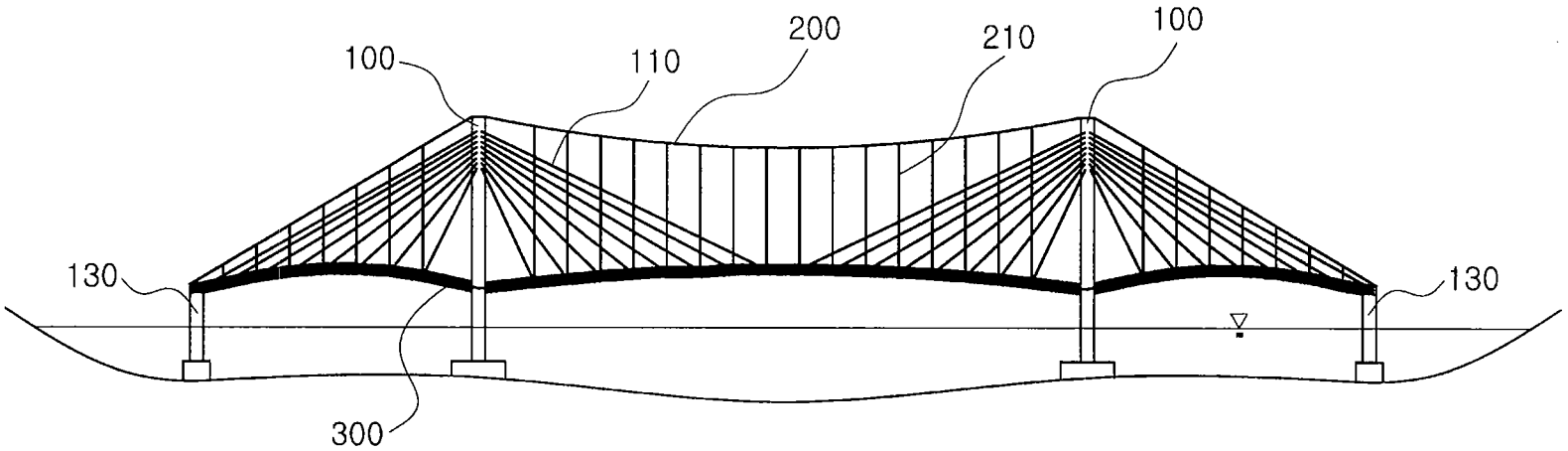

The salvaged segment 300 is installed by being connected to the lower end of the stay cable 110. In order to minimize displacement of the main tower 100 or the stay cable 110, the segment 300 is connected to the stay cable 100 stating from the main tower 100 in a direction toward the main span and the side span in sequence, as shown in FIGS. 15 and 16. If the segment 300 is installed from the both sides of the main tower 100 outwardly in sequence, the stay cables on the opposite sides are parallel to each other and accordingly the segment 300 is stably maintained. The segment 300 and the stay cable 110 are connected to each other in a related-art mechanical connection method and thus a detailed description thereof is omitted.

Figure 18:
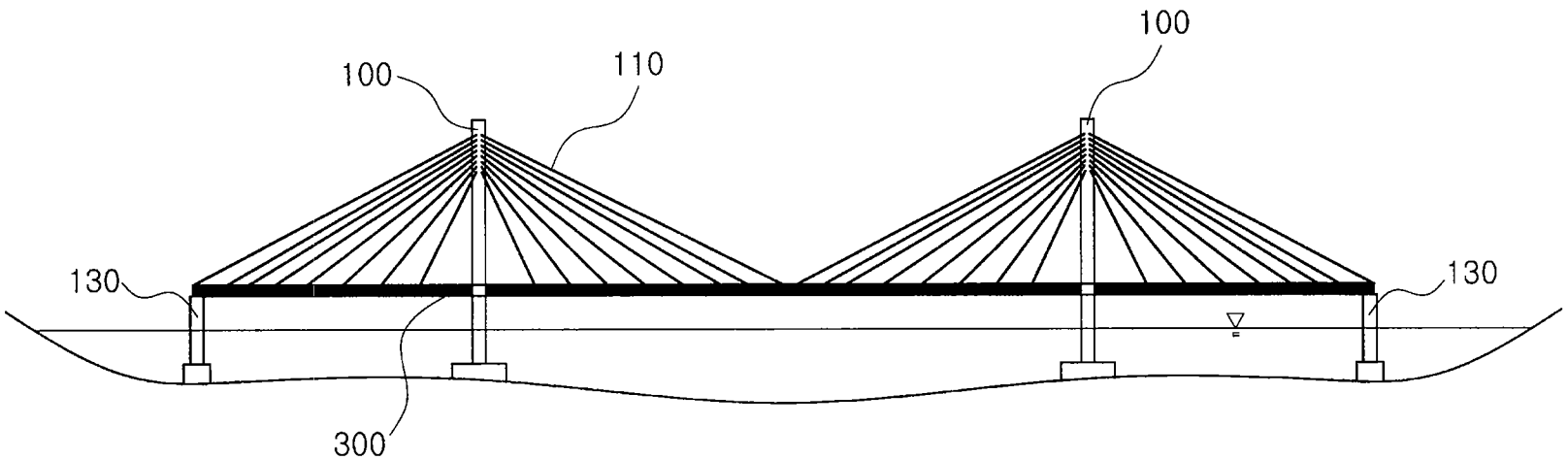

If the segment 300 is connected to the lower end of the stay cable 110, intension is introduced to the stay cable 110 due to an empty weight of the segment 300. If the girder is completed by installing the segments 300 and connecting the segments one another, the suspension cable 200, the hanger 210, and the anchorage cable 220 are all removed. That is, the suspension cable 200, the hanger 210, and the anchorage cable 220 are temporary cables and are removed after the girder is completed. Accordingly, the suspension cable 200, the hanger 210, and the anchorage cable 220 may use a cable of a relatively small cross section and may be recycled in plural times. If the suspension cable 200, the hanger 210, and the anchorage cable 220 are removed, the load of the segment 300 is supported by the stay cable 110 and is transmitted to the main tower 100, and a cable stayed bridge is completed as shown in FIG. 18.

If the segment 300 is a steel composite girder when being installed to construct the girder, a steel material girder is installed first and then a precast deck concrete is formed on the steel material girder. In another method, the steel material girder and the concrete deck are combined with each other at a manufacturing site in advance, and a segment in the form of a combined girder is manufactured in advance, and then the segment is salvaged, installed, and connected so that the girder can be formed.

In the present invention as described above, since the stay cable 110 is installed in advance and then the girder is constructed by salvaging the segment 300 in sequence and connecting the segments 300 one another, a time during which the segment 300 has a cantilever structure in the process of being connected to one another is shortened, in comparison with the related-art, and accordingly, the present invention does not require an extra wind resisting means unlike the related-art, and thus can save a cost.

Industrial Applicability

The present invention is very useful to construction of a bridge of a long span.

The invention claimed is:

1. A method for constructing a cable-stayed bridge with a plurality of tensionless stay cables, the method comprising the steps of:

constructing a plurality of main towers;

constructing a plurality of anchor piers, each of the plurality of anchor piers being located outside an area between the plurality of main towers;

installing a suspension cable over a main span between a pair of the plurality of main towers and over a plurality of side spans, each of the side spans being between a first of the main towers and one of the anchor piers installing a plurality of hangers to hang from the suspension cable, the hangers having a gap therebetween;

connecting an anchorage cable to a lower end of each of the hangers, and arranging the anchorage cable longitudinally by anchoring the anchorage cable to an upper end of each of the anchor piers and sections of the main towers, the anchorage cable extending over the main span and the side spans in a longitudinal direction;

sequentially installing stay cables a stay cable installation section by connecting each of the stay cables between an upper end of one of the main towers and the anchorage cable, the stay cables supporting a girder;

constructing the girder by pre-manufacturing girder segments constituting the girder, transferring the girder segments, installing the girder segments by sequentially connecting the girder segments to at least one of the stay cables, and connecting the girder segments to one another longitudinally; and removing the suspension cable, the hangers, and the anchorage cable.

2. The method of claim 1, wherein the step of sequentially installing the stay cables further comprises the steps of:

connecting an upper end of a first stay cable of the stay cables to the upper end of the first main tower of the pair of main towers by a temporary fixing hook prior to connecting a lower end of the first stay cable to the anchorage cable;

installing the temporary fixing hook at the upper end of the first main tower;

drawing up the upper end of the first stay cable using a crane and hooking the upper end of the first stay cable to the temporary fixing hook;

pulling the first stay cable toward a second main tower of the pair of main towers using a salvage ship;

connecting the lower end of the first stay cable to an anchorage device of the anchorage cable; and anchoring the upper end of the first stay cable to a permanent and secure anchorage portion of the first main tower after the lower end of the stay cable is connected to the anchorage cable.

3. The method of claim 1, wherein, in the step of installing the stay cables, the operation of connecting each of the stay cables between the upper end of one of the pair of main towers and the anchorage cable is performed sequentially and alternately on each main tower, from a center portion of the main span toward each main tower and a stay cable installation section of the side span located between each anchor pier and each main tower and installed on each main tower.

4. The method of claim 1, wherein, the girder segments are manufactured with a big block having a longitudinal length of 50 meters to 70 meters, and wherein the girder segments are sequentially and alternately installed, with respect to one of the main towers, by being connected to the stay cables, starting from one of the main towers, toward the main span and toward the side span.

5. A temporary cable for installing a stay cable for supporting a girder in a stress-free state in a cable-stayed bridge, having a plurality of main towers and a plurality of anchor piers located outside each of the main towers the temporary cable comprising:

a suspension cable which is installed over a main span between a plurality of main towers and over a side span between each of the main towers and the anchor piers;

a plurality of hangers vertically hanging from the suspension cable with a gap therebetween; and an anchorage cable extending over the main span and the side span in a longitudinal direction, the anchorage cable connecting to a lower end of each of the hangers the anchorage cable being arranged longitudinally, the anchorage cable being anchored to an upper end of one of the anchor piers and a section of one of the main towers, and the anchorage cable connecting to a lower end of the stay cable the stay cable having an upper end connecting to one of the main towers, and the stay cable being in a tensionless state before the girder is installed.

* * * * *

UNITED STATES PATENT AND TRADEMARK OFFICE

CERTIFICATE OF CORRECTION

PATENT NO. : 8,627,530 B2
APPLICATION NO. : 13/508313
DATED : January 14, 2014
INVENTOR(S) : Jong Kwan Byun et al.

It is certified that error appears in the above-identified patent and that said Letters Patent is hereby corrected as shown below:

On the Title Page

ADD THE SECOND RECORDED ASSIGNEE -- BYUN, JONG KWAN, BUSAN, KOREA --.

Signed and Sealed this
Twenty-seventh Day of October, 2015

Michelle K. Lee

Michelle K. Lee
*Director of the United States Patent and Trademark Office*